United States Patent [19]

Dolan

[11] Patent Number: 4,490,861

[45] Date of Patent: Jan. 1, 1985

[54] ROTATING TOILET BOWL DISPENSER

[76] Inventor: John E. Dolan, 15 New Main St., Haverstraw, N.Y. 10927

[21] Appl. No.: 575,826

[22] Filed: Feb. 1, 1984

[51] Int. Cl.[3] ..... E03D 9/02

[52] U.S. Cl. ..... 4/228; 4/227

[58] Field of Search ..... 4/227, 225, 228, 223

[56] References Cited

U.S. PATENT DOCUMENTS

| | | | |
|---|---|---|---|
| 724,209 | 3/1903 | Rockwell | 4/227 |
| 2,021,110 | 11/1935 | Strattman | 4/227 |
| 2,071,655 | 2/1937 | Purrman | 4/225 |
| 2,600,937 | 6/1952 | Strattman | 4/227 X |
| 2,644,167 | 7/1953 | Gordon | 4/227 |
| 2,732,850 | 1/1956 | Tauksbury | 4/227 X |
| 2,736,039 | 2/1956 | Majo | 4/227 |
| 2,888,685 | 6/1959 | Giangrosso et al. | 4/227 |
| 3,290,698 | 12/1966 | Joyner et al. | 4/228 |
| 4,296,503 | 10/1981 | Leardi | 4/228 |

*Primary Examiner*—Henry K. Artis

*Attorney, Agent, or Firm*—John F. Ohlandt

[57] ABSTRACT

Dispensing apparatus for dispensing bleach and/or detergent or the like into a toilet tank on a controlled basis. The dispenser is rotatable or tiltable; being divided into several portions, one of which is a reservoir, preferably provided at the top of the structure, such reservoir determining the controlled "shot" or dosage to be dispensed. In operation, the dispenser is buoyed up by incoming water such that it rotates, and the reservoir becomes partly filled; but water cannot enter, to any significant extent, from the reservoir into the main chamber of the dispenser. When the water level drops sufficiently in the tank, the device then rotates to an upright position, the trapped air no longer contributing to the buoyancy of the device. Also, the water present in the reservoir can now enter the container and cause the cleaning solution, formed from a cake of bleach or blue dye/detergent, to overflow and be dispensed into the toilet tank and thence to the toilet bowl.

10 Claims, 5 Drawing Figures

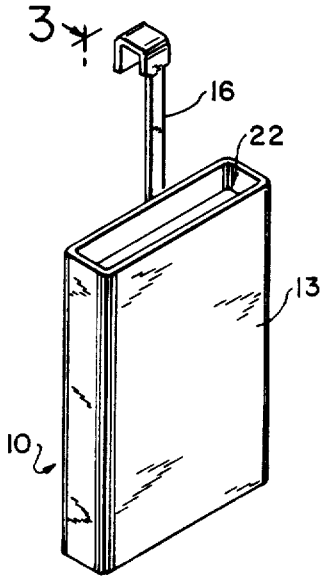
FIG.1
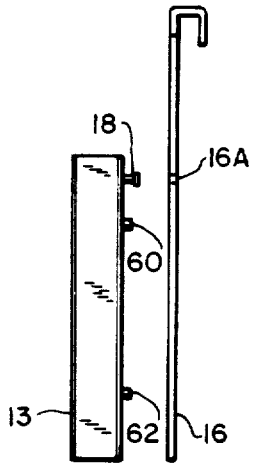
FIG.2
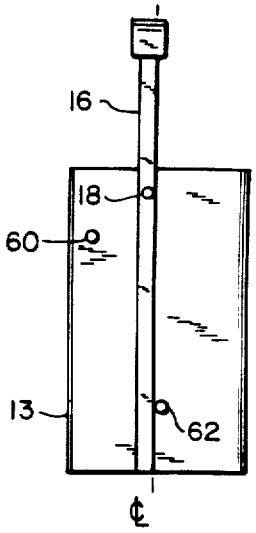
FIG.3
FIG.4
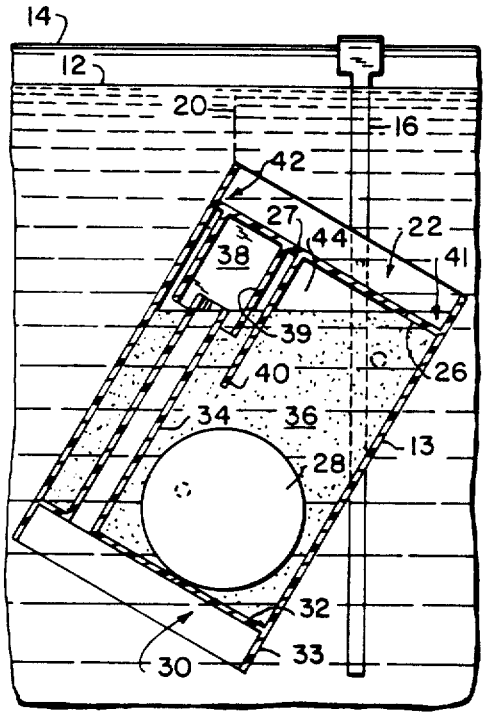
FIG.5
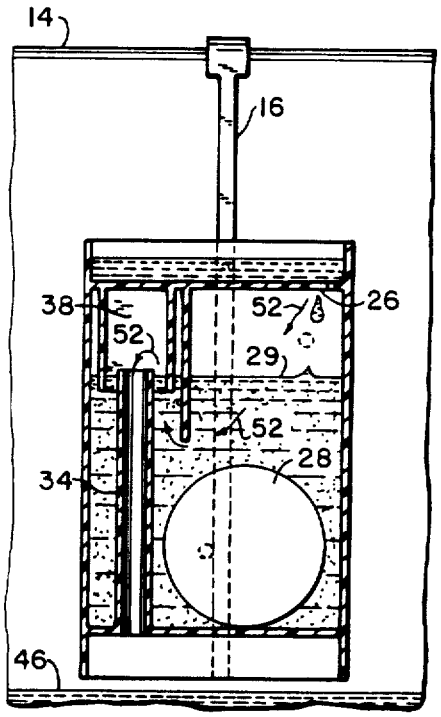

ROTATING TOILET BOWL DISPENSER

BACKGROUND OF THE INVENTION

1. Field of the Invention

The present invention pertains to an automatic dosingtype dispenser for such products as toilet tank additives; for instance, bleaches, detergents and dyes or the like. More specifically, the present invention is directed to a rotatable dispenser which has no internal moving parts, but instead relies on movement of the entire dispenser to produce the necessary dispensing action.

2. Background Information

Inasmuch as detailed background information may be found in related application Ser. No. 265,555 filed May 20, 1981, now U.S. Pat. No. 4,370,763 issued on Feb. 1, 1983, reference may be made to such patent.

It is considered sufficient to indicate here that there has existed a long standing need for apparatus for dispensing bleach, detergent and dye or the like, on an automatic basis into a toilet bowl so as to be sure that the bowl will be kept in a completely sanitary state, or at least be in such state as to require very infrequent cleaning by the user.

Similarly to the invention of related U.S. Pat. No. 4,370,763, the present invention relies on certain flotation principles, as well as appropriate pivoting of the dispenser structure. However, the present invention provides an improved arrangement utilizing such principles for efficient and economic dispensing of a liquid solution. Moreover, such arrangement minimizes leaching of the cleaning or liquid solution into the toilet tank between flushes.

SUMMARY OF THE INVENTION

A primary feature of the invention resides in the provision for maintaining a rotatable dispenser in an upright position when the flush water in the tank is at a low level and for selectively causing rotation to another position when the flush water is at a high level, so as to enable the dispensing of a dose amount of cleaning solution when the dispenser returns to the upright position. The container of the dispenser has a main chamber in which cleaning solution is disposed. After initial flushing of the tank subsequent to placing the dispenser in a toilet tank, the dispenser main chamber becomes filled up with cleaning solution to the level of a discharge tube situated within the container. A buoyancy enhancing means in the form of an air trap is situated in the upper portion of the container; means are provided for rotating the container in a direction away from the normally upright position responsive to the level of the body of liquid in the tank rising sufficiently to produce buoyancy effects due to the buoyancy enhancing means. A reservoir above the main chamber defines the dose amount of cleaning solution, such reservoir having an opening communicating with the interior of the container adjacent one side thereof, and the reservoir being partly filled as the tank level rises sufficiently. The container is rotatable in the opposite direction to the first direction responsive to the level of the body of liquid dropping sufficiently to negate the aforesaid buoyancy effects, whereby the defined dose amount of cleaning solution is then dispensed.

Other and further objects, advantages and features of the present invention will be understood by reference to the specification in conjunction with the annexed drawing, wherein like parts have been given like numbers.

BRIEF DESCRIPTION OF THE DRAWING

FIG. 1 is a perspective view of a dispenser in accordance with the invention, which is adapted to be mounted in a toilet tank.

FIG. 2 is a side elevational view which illustrates the dispenser, and the holder therefor spaced from the dispenser.

FIG. 3 is a rear elevational view of the dispenser.

FIG. 4 is a front elevational view of the dispenser, shown mounted and in operation in a toilet tank.

FIG. 5 is a front elevational view of the dispenser, shown in another operational position.

DESCRIPTION OF PREFERRED EMBODIMENT

Referring first to FIGS. 1-5, there will be seen a dispenser device 10 in accordance with the present invention and, particularly as seen in FIG. 4, such device includes a container 13 completely immersed in a body of water that fills the tank to the level 12, this being due to the fact that flush water in a tank 14 has risen to its highest level. The container 13 is supported by means of a holder 16 which is adapted to hook over the periphery of the tank 14. The container is suitably pivoted at point 18, whereby it can move about such point as circumstances dictate. It will be seen that a compartment defining a reservoir 22 is formed in the upper portion of container 13. A suitable opening 26, adjacent the right side of the reservoir, is disposed in a wall 27 of the compartment, which corresponds with the top wall of the container. A cake or solid block 28 of detergent, typically combined with bluing, is disposed within the container 13. When water flows into the container, after initial flushes of the tank, a suitable liquid solution of the aforenoted ingredients is produced to a level designated 29 (FIG. 5).

Also defined at the bottom of container 13 is a compartment 30 optionally included as a further means of trapping air. This compartment is completely open at its bottom and is defined by a wall 32, which corresponds with the bottom wall of the container, and by side walls 33; further the compartment communicates with a discharge tube 34, which extends upwardly inside the main chamber 36 within the container 13. As will be appreciated from FIG. 4, the container 13 is in a position, due to its inherent buoyancy, as a consequence of trapped air, at an angle of approximately 120° from the imaginary vertical line 20 (shown as a broken line).

Situated immediately above the upper end of discharge tube 24 is another compartment 38 which is defined by the wall 27 and by walls 39 extending downwardly inside the container. This compartment serves to trap air as the dispenser is operated. A baffle 40 extends from the upper inner surface of the container down into the chamber 36. This is for the purpose of insuring that incoming water will be mixed with the cake or block 28 before being discharged or dispensed.

By reference to FIG. 2, the holder arrangement which permits proper tilting of the container, will be understood. The holder 16 is provided with a suitable opening 16A into which the pivot pin 18 is snap fitted. Stops 60 and 62 on the rear of the container restrict the movement of container 13 to a selected tilted position and to the upright position, respectively, as illustrated.

In the operation of the dispenser of the present invention, let it first be considered that the water level in the tank is up to its maximum level 12, as seen in FIG. 4. In such situation, the right hand bottom corner 41 of the reservoir 22 is lower than the opposite corner 42. Because of this position, tank water will begin to partly fill the reservoir 22 immediately upon reaching the right portion of the reservoir rim. This amount of water contained in the reservoir is determinative of the "shot" or dose size. Because of the air trap produced by the configuration of compartment 38, water has not been permitted to completely fill the main chamber 36. Moreover, air is also trapped in the portion 44 inside container 13, when the container tilts as seen in FIG. 4.

Now let it be assumed that the tank water level drops upon initiation of a flushing cycle. As seen in FIG. 5, when the water level has dropped to the level indicated by the numeral 46, then the dispenser will have rotated to a horizontal position as indicated. This is due to the fact that air is no longer trapped within the dispenser, such that the dispenser is no longer acted upon by sufficient buoyant forces. The important point to note is that as the dispenser rotates in the counterclockwise direction, the quantity of water in the reservoir 22 begins to enter the container through opening 26. Eventually, i.e. when the air which has been trapped is released, the quantity of liquid in the reservoir completely enters the container, thereby displacing an equivalent amount of cleaning solution that is formed in the chamber 36 around the cake 28. Such displaced amount will flow out through the discharge tube 34 and be dispensed into the tank. This action is indicated by a series of arrows 52.

It will be understood that when the water rises again at the completion of the cycle, the whole cycle can be initiated again by flushing of the tank.

While there has been shown and described what is considered at present to be the preferred embodiment of the present invention, it will be appreciated by those skilled in the art that modifications of such embodiment may be made. It is therefore desired that the invention not be limited to this embodiment, and it is intended to cover in the appended claims all such modifications as fall within the true spirit and scope of the invention.

I claim:

1. A dispenser immersible in a body of liquid in a toilet tank for dispensing cleaning solution or the like into said tank comprising a container having a main chamber in which cleaning solution is disposed;

buoyancy enhancing means in the form of an air trap situated in the upper portion of said container;

means for rotating said container in a first direction responsive to the level of the body of liquid rising sufficiently to produce buoyancy effects on the container due to said buoyancy enhancing means;

a reservoir above said chamber for determining or defining the dose amount of cleaning solution to be dispensed, said reservoir having an opening communicating with the interior of said container adjacent one side thereof;

said reservoir being partly filled as said liquid level rises sufficiently in the tank;

means for rotating said container in a second direction opposite to the first direction responsive to the level of the body of liquid dropping sufficiently to negate the buoyancy effects on the container, whereby said dose amount of cleaning solution is then dispensed.

2. Apparatus as defined in claim 1, in which said dose amount of cleaning solution is dispensed due to the liquid disposed in the reservoir entering the container and causing an equivalent amount of cleaning solution therein to discharge.

3. Apparatus as defined in claim 1, in which said container includes bottom, top and side walls.

4. Apparatus as defined in claim 1, in which said cleaning solution is formed by tank water dissolving a solid cake of bleach or detergent inside said container.

5. Apparatus as defined in claim 1, in which a first compartment is defined at the upper end of said container so as to provide an air trap.

6. Apparatus as defined in claim 5, in which said first compartment serving as an air trap is defined by the top wall of said container and by side walls extending downwardly into said container.

7. Apparatus as defined in claim 5, in which a discharge tube, which is open at both ends, communicates at its lower end with said first compartment.

8. Apparatus as defined in claim 5, in which a second compartment serves as said reservoir, said compartment being defined by the top wall of said container and by side walls extending above said main chamber.

9. Apparatus as defined in claim 8, in which a third compartment is defined at the lower end of said container.

10. Apparatus as defined in claim 9, in which a baffle extends downwardly into said container from said top wall.

* * * * *